US005127874A

United States Patent [19]

Wiles

[11] Patent Number: 5,127,874

[45] Date of Patent: Jul. 7, 1992

[54] CHIMNEY DAMPER WITH HAMMER DEVICE

[76] Inventor: Jeffrey B. Wiles, P.O. Box 505, Jeffersonville, Ind. 47131

[21] Appl. No.: 725,337

[22] Filed: Jul. 3, 1991

[51] Int. Cl.[5] ..... F23L 17/02

[52] U.S. Cl. ..... 454/7; 126/286

[58] Field of Search ..... 126/286; 454/5, 7

[56] References Cited

U.S. PATENT DOCUMENTS

| | | | |
|---|---|---|---|
| 3,945,307 | 3/1976 | Lyemance | 454/7 |
| 4,165,679 | 8/1979 | Lyemance | 454/7 |
| 4,528,897 | 7/1985 | Homolik | 454/7 |
| 5,080,006 | 1/1992 | Vorvick | 454/7 |

*Primary Examiner*—Harold Joyce

*Attorney, Agent, or Firm*—Scott R. Cox

[57] ABSTRACT

A chimney flue damper comprised of a generally rectangular frame, a damper flap pivotally mounted to the frame, a hammer element secured to the bottom of the damper flap and a cable. A bar of the hammer element is rotatably secured to the bottom of the damper flap. A hammer element head of the hammer element can be pulled away from the surface of the damper flap by pulling the cable downward in the flue. By releasing the cable, the hammer element head will strike the bottom of the damper flap and thus open a damper flap which is stuck closed, either by ice forming on the seal between the damper flap and the frame or as a result of an accumulation of foreign material around the edge of the damper flap.

5 Claims, 3 Drawing Sheets 10
26
34
28
30
14
22
24
12
32
46
50
16
20
18
62
64

CHIMNEY DAMPER WITH HAMMER DEVICE

BACKGROUND OF THE INVENTION

1. Field of Invention

This invention relates to chimney dampers. More particularly, this invention relates to an improved chimney damper containing a means for opening the chimney damper even when it is stuck closed.

2. Prior Art

In homes and other buildings having a fireplace, the fireplace opening is connected to a chimney flue which is open to the outside of the building. When in use, the combustion products from the fireplace pass up through the flue and exit the chimney in a conventional fashion.

When the fireplace is not in use, however, the fireplace opening and chimney flue form a passage through which heat can escape from the interior of the building. Although most fireplaces contain conventional fireplace dampers at the bottom of the flue or immediately above the fireplace opening, these fireplace dampers do not usually provide an adequate seal for the chimney flue. This inadequate seal permits a great deal of heat loss through the chimney flue.

A number of chimney dampers have been produced which are mounted on the top of the chimney to provide a better seal and thus reduce the amount of heat lost through the chimney flue. Various types of chimney dampers are available. For example, one well known type of chimney damper is a cap-type flue damper as shown in U.S. Pat. Nos. 4,554,863, 4,181,119 and 4,020,754.

Another common type of chimney damper has a lid attached to the side of the chimney by hinges as shown in U.S. Pat. Nos. 4,691,624, 4,528,897, 4,483,315, 4,368,663 and 2,856,839.

Another common type of chimney damper contains a frame secured to the top of the chimney and a flap which is pivotally attached to the frame to provide an improved method of both closing the flue and also preventing air and water from flowing over the damper flap into the chimney. See, for example, U.S. Pat. No. 2,704,502 and the particularly preferred inventions shown in U.S. Pat. Nos. 3,945,307 and 4,165,679.

A disadvantage of many of the previously known dampers is that the exposed surface of the damper contains areas in which water may collect. This water, upon freezing, can lock the damper in a closed position creating a safety hazard for operation of the fireplace. One method of solving this problem was proposed in U.S. Pat. No. 3,945,307 which discloses a cup (15) which is attached to a spring (13) secured to the bottom of a damper flap (7) such that when the spring is stretched and then released, the cup moves abruptly upward to strike the underside of the damper flap. This striking of the damper flap is designed to free a stuck damper flap. While this method of freeing a stuck damper flap works in some situations, improved methods of releasing a stuck damper flap are still needed to assure that the damper flap never remains in a closed position as a result of the accumulation of ice, creosote or other material build up.

Accordingly, it is an object of this invention to provide a chimney damper containing a device which frees a stuck damper flap.

It is another object of this invention to provide a chimney damper which operates under many different weather conditions.

It is a still further object of this invention to provide a chimney damper which is easy to install and inexpensive to produce.

These and other objects are provided by the improved chimney damper of the instant invention.

SUMMARY OF THE INVENTION

The instant invention is an improved chimney damper comprised of a generally rectangular frame containing a substantially u-shaped inwardly turned channel, an upstanding damper flap which is pivotally mounted on the frame, a hammer element secured to the bottom surface of the damper flap, a spring member secured to the hammer element and a cable secured to the bottom surface of the damper flap and to the spring member, wherein the hammer element can be rotated away from the bottom surface of the damper flap and then released to strike the bottom surface of the damper flap with force to free the damper flap if it is stuck in a closed position. The operation of this improved chimney damper prevents a damper flap from remaining stuck and permits the unsticking of the damper flap from inside the building containing the chimney. This device is an improvement over all existing chimney dampers.

BRIEF DESCRIPTION OF THE DRAWINGS

This invention will now be described with reference to the accompanying drawings in which.

DETAILED DESCRIPTION OF THE PREFERRED EMBODIMENT

Figure 1:
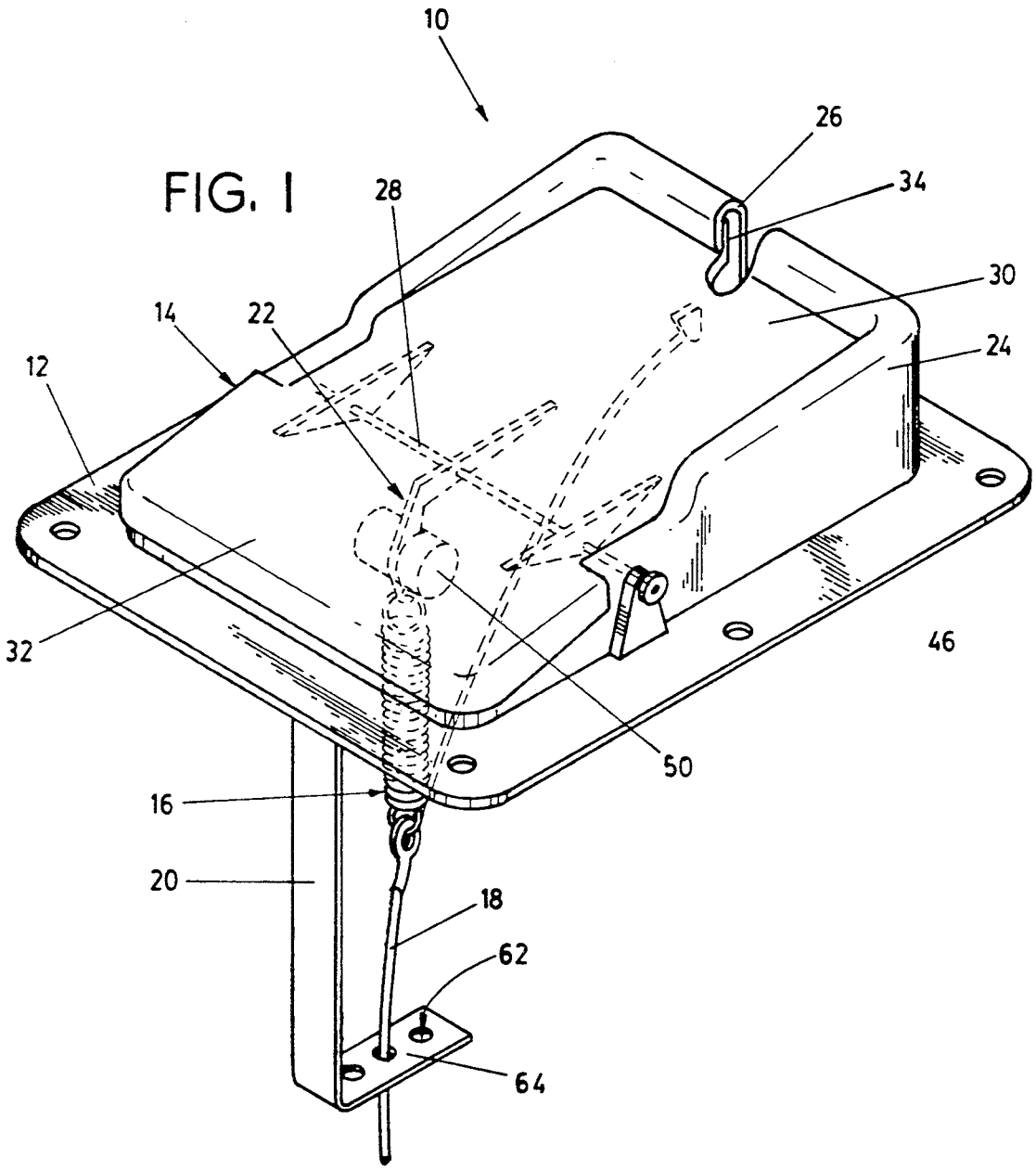
FIG. 1 shows a perspective view, partially in section, of the improved damper in accordance with the present invention in its closed position.

Although the invention is adaptable to a wide variety of uses, it is shown in the drawings for purpose of illustration as an improved chimney damper (10) comprised of a generally rectangular frame (12), an upstanding damper flap (14), a spring member (16), a cable (18), a support arm (20) and a hammer element (22). See FIG. 1.

The generally rectangular frame (12) is designed to rest on the top of the outlet of a flue of a chimney (not shown). The frame (12) includes an upstanding, generally rectangular flange (24) provided with an inverted channel member (26) at the top edge thereof which extends partially around the periphery of the flange. In an optional embodiment a sleeve (not shown) secured to the underside of the frame, can extend downwardly into the flue of the chimney to provide additional support for the chimney damper.

Figure 2:
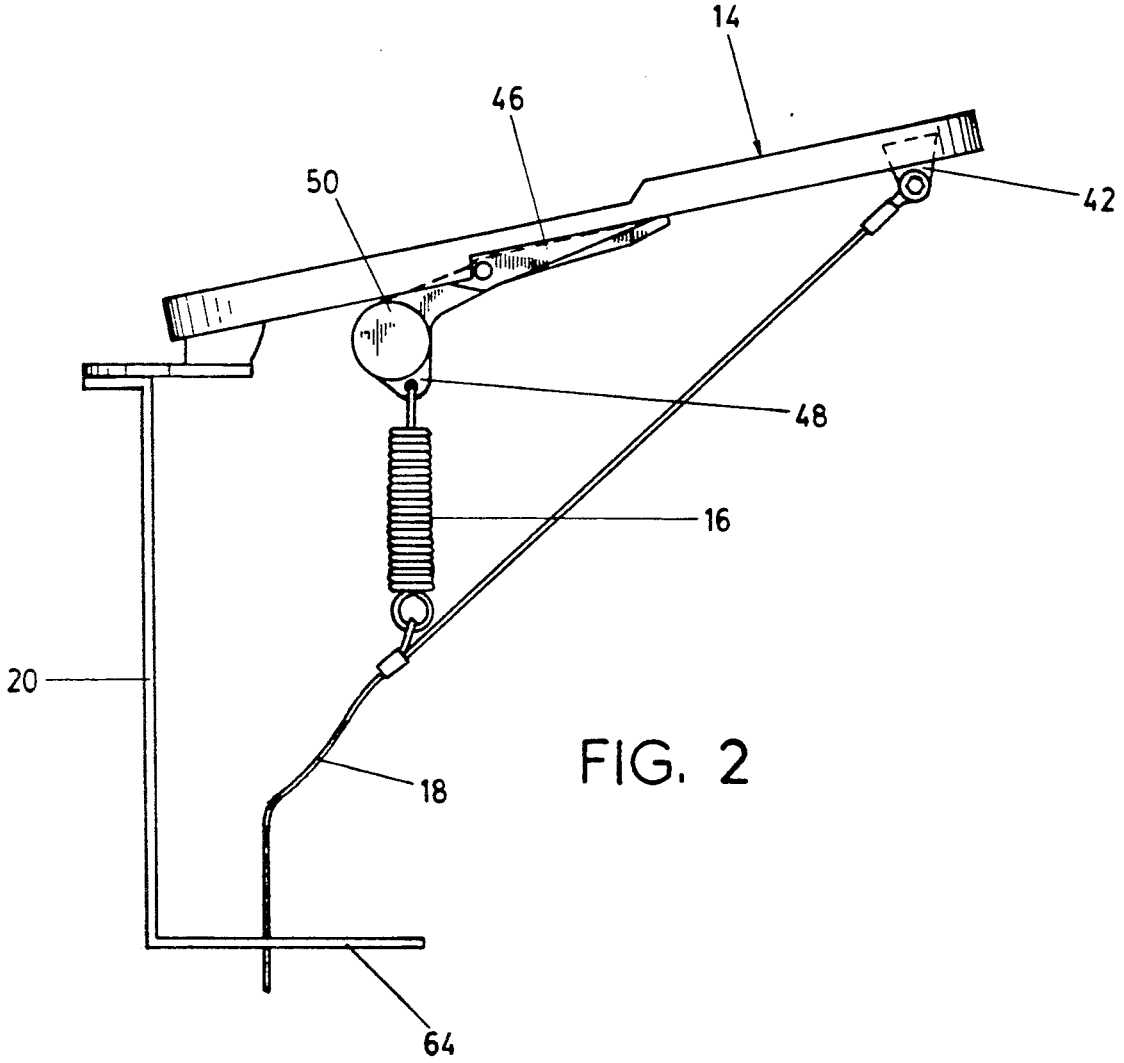
FIG. 2 presents a partially cut away illustration of the device shown in FIG. 1.

The damper flap (14) is secured to the frame (12), for example, by means of a pivot member (28). The damper flap (14) contains a first (30) and second end (32) on either side of the pivot member (28) wherein said first end (30) is significantly longer and heavier than the second end (32). The damper flap includes a downwardly extending lip around a portion of the second end (22) which extends beyond the limits of the flange. An upstanding flange (34) is provided around the first end of the periphery of the flap to be received in the channel (26) of the frame to provide a seal between the flange and damper extending substantially around the flange and the periphery of the damper. When the damper flap (14) is closed, the upstanding flange (34) of the damper flap is in engagement with the inverted channel member (26) of the frame. When the damper flap (14) is unrestrained, the damper flap rotates about the pivot bar (28) out of engagement with the channel member (26) to an open, generally vertical position exposing an opening in the chimney damper. See FIG. 2.

The pivot bar (28) runs through openings in the sides of the frame and is secured to the bottom of the damper flap through a pair of pivot member braces (38). The pivot member braces (38) are secured to the bottom of the damper flap (14) or, preferably are an element of the pre-cast, one-piece damper flap. The pivot bar (28) is held in place by conventional means at each end. Placed over the pivot bar (28) near one end is a pivot spring (40) which, by its interaction between the damper flap (14) and the frame (12), encourages the damper flap to an open position. If required, a weight (not shown) can also be secured to the first end of the damper flap to provide additional force tending to force the damper flap to an open position. By the combination of the gravitational forces due to the heavier first end (30) of the damper flap, an optional weight secured to the bottom portion of the first end (30) of the damper flap and the operation of the pivot spring (40), the damper flap (14) will be forced in to an open position if not restrained. The damper flap (14) will remain open unless secured shut by the occupant of the building in which the chimney is located.

A cable bracket (42) is secured to the underside of the second end of the damper flap or in a preferred embodiment the cable bracket (42) is an element of the pre-cast damper flap. The cable (18) is connected to the cable bracket (42) and extends downward in the chimney to the fireplace. The cable (18) is conventional as is shown for example in U.S. Pat. Nos. 3,945,307 and 4,165,679. The chimney damper (14) can be closed by pulling the cable (18) downward to force the damper flap (14) to a closed position. The chimney damper flap (14) remains closed when the cable (18) is secured in place by a latch element (not shown) which is well known in the industry.

A sealing compound (not shown) can be provided on the top surface of the damper flap (14) to provide a better seal between the damper flap (14) and the frame (12).

Attached to the pivot bar (28), adjacent to the second end (32) of the damper flap, is the hammer element (22). In a preferred embodiment, the hammer element (22) is comprised of a hammer bar (46), a spring bracket (48), a hammer element head (50) and a hammer pivot spring (52). The hammer bar (46) is rotatably secured on the pivot bar (28). The pivot bar (36) passes through an opening in the hammer such that the hammer bar (46) can rotate freely about the pivot bar. The pivot bar is angled such that it can rotate at least about 10° and preferably at least 20° from the surface of the damper flap.

Figure 3:
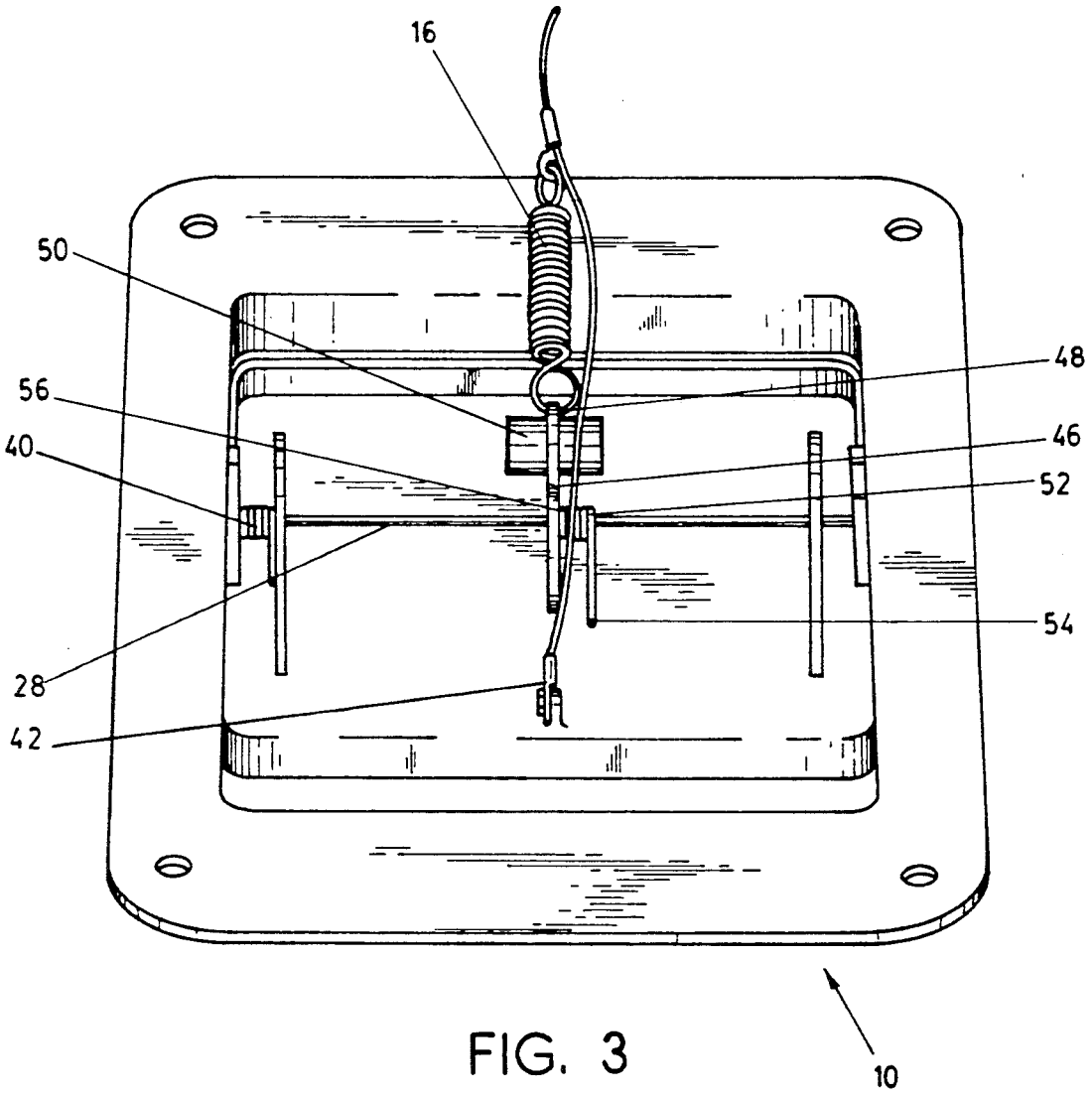
FIG. 3 shows a partially cut away, bottom view of the device shown in FIG. 1.

Secured to one end of the hammer bar (46) is the hammer element head (50). The head can be of any shape or size as long as it has sufficient weight to strike effectively the surface of the damper flap (14). In a preferred embodiment, the hammer element head (50) is cylindrical in shape with a diameter of at least one-half inch and a height of at least 1 inch. The hammer element head should be constructed of high strength steel or other such material. See FIG. 3. Adjacent to the hammer bar (46) is the hammer pivot spring (52) which encircles the pivot bar (28) with its first end (54) against the damper flap and second end (56) passing over the hammer bar (46). The hammer pivot spring (46) is biased to force the hammer element head (50) upward toward the surface of the damper flap. If preferred, the hammer bar may be held in place on the pivot bar (36) by E-clips (58) on either side of the hammer bar around the pivot bar (28). Secured to the same end of the hammer as is the hammer element head bar is the spring bracket (48). One end of the spring member (16) is secured to the spring bracket (48) with the other end attached to the cable. When the cable (18) is pulled downward beyond its normal closing position, the cable pulls on the spring member (16), which in turn pulls on the spring bracket (48) of the hammer element (22). By continued pulling on the cable, the hammer element head (50) is pulled away from the surface of the damper flap (14). After the hammer element head (50) is pulled away from the surface, the hammer element head (50) can be released by releasing the cable (18). The hammer element head (50) will then strike the surface of the damper flap to assist in releasing a stuck damper flap.

The support arm (20) of the instant invention is an optional element and is attached to the rectangular frame. It is located so that the cable (18) passes through an opening (62) at the bottom (64) of the support arm (20). While the support arm (20) is shown as an extended arm having an opening at the bottom, the support arm (20) may also take the form of a tube or other means such as a bottom eyelet which has a fixed bottom opening through which the cable (16) may pass.

In operation, the frame (12) of the chimney damper is placed on the top of the chimney and secured in place by a conventional securing means such as an adhesive, bolts, screws or other conventional means of securing. In an alternative embodiment, a sleeve may be secured to the bottom surface of the frame which will fit within the chimney. The damper flap (14) is normally biased in an open position and this open position is achieved by the pivot bar (28) being off center so that the first end (30) of the damper flap (14) is heavier. In addition, the pivot spring (40) increases the bias of the damper flap (14) to an open position. The cable (18) passes through the support arm (20) which assures that the cable (18) will pass directly downward through the chimney. To close the damper flap (14), the cable (18) is pulled and the cable (18) is fastened to the latch element (not shown) located near the fireplace. Upon release of the cable from the latch element, the damper flap (14) rotates open by gravitational forces and by pressure exerted by the pivot spring (40). This extends the damper flap (14) to a generally vertical position, opening the flue for use. In the event that the cable (18) breaks, the damper flap will always "fail safe" to an open position because of the gravitational forces placed on the first end (30) of the damper flap (14) and by operation of the pivot spring (40).

To increase the force applied to the damper flap (14) to open it when it is stuck shut, either by the accumulation of water frozen in place or by the accumulation of foreign material around the edge of the damper flap, further pulling of the cable beyond its closed position will pull the spring member (16) which will then pull the hammer element head (50) away from the surface of the damper flap (14). Release of the cable then results in the hammer element head (50) striking the bottom surface of the damper flap (14), thus freeing it for rotation to its open position.

What is claimed:

1. A chimney damper comprised of (a) a frame;

(b) a damper flap pivotally mounted on the frame;

(c) a rotational hammer means secured to the bottom of the damper flap, spring means provided to bias the hammer means upward toward the surface of the damper flap; and (d) a cable secured to the damper flap and also secured to the hammer means through a spring member which is itself secured to the hammer means whereby upon pulling on the cable the damper flap will close and upon further pulling on the cable and then release thereof, the hammer head of the hammer means strikes the bottom of the damper flap if it is closed.

2. The chimney damper of claim 1 wherein the rotational hammer means is comprised of a hammer bar pivotally mounted on a pivot bar secured to the bottom of the damper flap, a hammer head secured to the hammer bar, and a hammer pivot spring secured around the pivot bar.

3. The chimney damper of claim wherein the frame contains a substantially u-shaped inwardly turned channel.

4. The chimney damper of claim 1 wherein the damper flap is pivotally mounted to the frame by a pivot means such that a portion of the damper flap on one side of the pivot means is heavier than that portion of the damper flap on the other side of the pivot means.

5. The chimney damper of claim 1 wherein the cable passes through a support arm which supports the cable.

* * * * *